US007789749B2

(12) United States Patent
Bansemer et al.

(10) Patent No.: US 7,789,749 B2
(45) Date of Patent: Sep. 7, 2010

(54) GAMING DEVICE HAVING PERCEIVED SKILL

(75) Inventors: Mark W. Bansemer, Reno, NV (US); James G. Nolz, Reno, NV (US)

(73) Assignee: IGT, Reno, NV (US)

( * ) Notice: Subject to any disclaimer, the term of this patent is extended or adjusted under 35 U.S.C. 154(b) by 1027 days.

(21) Appl. No.: 11/420,373

(22) Filed: May 25, 2006

(65) Prior Publication Data

US 2006/0205474 A1 Sep. 14, 2006

Related U.S. Application Data

(62) Division of application No. 10/832,729, filed on Apr. 27, 2004, now Pat. No. 7,056,210, which is a division of application No. 09/682,408, filed on Aug. 30, 2001, now Pat. No. 6,761,632.

(60) Provisional application No. 60/229,409, filed on Aug. 31, 2000.

(51) Int. Cl.
*A63F 9/24* (2006.01)

(52) U.S. Cl. ..... 463/20

(58) Field of Classification Search ..... 463/20
See application file for complete search history.

(56) References Cited

U.S. PATENT DOCUMENTS

| | | | | |
|---|---|---|---|---|
| 1,854,479 A | | 4/1932 | Mills | |
| 4,363,485 A | | 12/1982 | Edwall | |
| 4,582,324 A | * | 4/1986 | Koza et al. | 463/16 |
| 4,618,150 A | | 10/1986 | Kimura | |
| 4,652,998 A | | 3/1987 | Koza et al. | |
| 4,695,053 A | | 9/1987 | Vazquez, Jr. et al. | |
| 4,743,024 A | | 5/1988 | Helm et al. | |
| 4,770,415 A | | 9/1988 | Evans | |
| 4,773,647 A | | 9/1988 | Okada et al. | |

(Continued)

FOREIGN PATENT DOCUMENTS

EP 375190 A2 6/1990

(Continued)

OTHER PUBLICATIONS

Office Action dated Sep. 11, 2003 for U.S. Appl. No. 09/682,407.

(Continued)

*Primary Examiner*—Corbett B Coburn
(74) *Attorney, Agent, or Firm*—K&L Gates LLP

(57) ABSTRACT

A gaming device wherein a player's skill at an action or event determines or appears to determine the player's success or failure. In reality, a database of information stores a number of successful results, and the game selects an award for each successful result. The action or event involves skill in real life, which requires the player to estimate the time an action will require and/or requires the player to aim at an object or estimate the direction necessary to successfully produce a result. The game can employ software adapted to determine if a player's aim or timing is successful. The game can alternatively randomly determine the player's success. The game displays the player's attempt or action on the screen depicting success or failure and awards gaming device credits or multipliers for successful results.

24 Claims, 12 Drawing Sheets

U.S. PATENT DOCUMENTS 5,116,055 A 5/1992 Tracy
5,280,909 A 1/1994 Tracy
5,308,065 A 5/1994 Bridgeman et al.
5,340,317 A 8/1994 Freeman
5,342,047 A 8/1994 Heidel et al.
5,342,049 A 8/1994 Wichinsky et al.
5,344,144 A 9/1994 Canon
5,393,061 A 2/1995 Manship
5,411,271 A 5/1995 Mirando
5,524,888 A 6/1996 Heidel
5,536,016 A 7/1996 Thompson
5,542,669 A 8/1996 Charron et al.
5,560,603 A 10/1996 Seelig et al.
5,611,730 A 3/1997 Weiss
5,645,486 A 7/1997 Nagao et al.
5,766,074 A 6/1998 Cannon et al.
5,769,716 A 6/1998 Saffari et al.
5,772,509 A 6/1998 Weiss
5,779,549 A 7/1998 Walker et al.
5,788,573 A 8/1998 Baerlocher et al.
5,805,444 A 9/1998 Seymour
5,823,873 A 10/1998 Moody
5,823,874 A 10/1998 Adams
5,833,536 A 11/1998 Davids et al.
5,848,932 A 12/1998 Adams
5,871,398 A 2/1999 Schneier et al.
5,873,781 A 2/1999 Keane
5,882,259 A 3/1999 Holmes et al.
5,882,261 A 3/1999 Adams
5,910,046 A 6/1999 Wada et al.
5,911,418 A 6/1999 Adams
5,941,770 A 8/1999 Miers et al.
5,951,397 A 9/1999 Dickinson
5,967,894 A 10/1999 Kinoshita et al.
5,997,401 A 12/1999 Crawford
6,015,346 A 1/2000 Bennett
6,019,369 A 2/2000 Nakagawa et al.
6,033,307 A 3/2000 Vancura
6,047,963 A 4/2000 Pierce et al.
6,050,895 A 4/2000 Luciano, Jr. et al.
6,056,642 A 5/2000 Bennett
6,071,192 A 6/2000 Weiss
6,089,976 A 7/2000 Schneider et al.
6,089,977 A 7/2000 Bennett
6,089,978 A * 7/2000 Adams ..... 463/20
6,102,798 A 8/2000 Bennett
6,110,039 A 8/2000 Oh
6,110,041 A 8/2000 Walker et al.
6,117,007 A 9/2000 Matsuyama et al.
6,117,008 A 9/2000 Machiguchi
6,120,031 A 9/2000 Adams
6,126,165 A 10/2000 Sakamoto
6,126,541 A 10/2000 Fuchs
6,126,547 A 10/2000 Ishimoto
6,135,884 A 10/2000 Hedrick et al.
6,135,885 A 10/2000 Lermusiaux
6,139,013 A 10/2000 Pierce et al.
6,142,873 A 11/2000 Weiss et al.
6,142,874 A 11/2000 Kodachi et al.
6,146,273 A 11/2000 Olsen
6,159,095 A 12/2000 Frohm et al.
6,159,097 A 12/2000 Gura
6,165,070 A 12/2000 Nolte et al.
6,174,233 B1 1/2001 Sunaga et al.
6,174,234 B1 1/2001 Seibert et al.
6,174,235 B1 1/2001 Walker et al.
6,190,255 B1 2/2001 Thomas et al.
6,203,010 B1 3/2001 Jorasch et al.
6,210,279 B1 4/2001 Dickinson
6,220,593 B1 4/2001 Pierce et al.
6,220,961 B1 4/2001 Keane et al.
6,224,482 B1 5/2001 Bennett
6,224,484 B1 5/2001 Okuda et al.
6,231,442 B1 5/2001 Mayeroff
6,231,445 B1 5/2001 Acres
6,234,897 B1 5/2001 Frohm et al.
6,237,913 B1 5/2001 Kamille
6,238,288 B1 5/2001 Walker et al.
6,251,013 B1 6/2001 Bennett
6,261,177 B1 7/2001 Bennett
6,267,669 B1 7/2001 Luciano, Jr. et al.
6,270,409 B1 8/2001 Shuster
6,270,411 B1 8/2001 Gura et al.
6,287,194 B1 9/2001 Okada et al.
6,293,866 B1 9/2001 Walker et al.
6,302,790 B1 10/2001 Brossard
6,309,298 B1 10/2001 Gerou
6,309,299 B1 10/2001 Weiss
6,315,660 B1 11/2001 Demar et al.
6,364,768 B1 4/2002 Acres et al.
6,413,160 B1 7/2002 Vancura
6,413,161 B1 7/2002 Baerlocher et al.
6,416,409 B1 7/2002 Jordan
6,435,511 B1 8/2002 Vancura et al.
6,439,995 B1 8/2002 Hughs-Baird et al.
6,443,837 B1 9/2002 Jaffe et al.
6,488,580 B1 12/2002 Robb
6,506,118 B1 1/2003 Baerlocher et al.
6,537,150 B1 * 3/2003 Luciano et al. ..... 463/16
6,569,015 B1 5/2003 Baerlocher et al.
6,582,306 B1 6/2003 Kaminkow
6,761,632 B2 7/2004 Basenmer et al.
6,767,284 B1 7/2004 Koza
6,780,103 B2 8/2004 Bansemer et al.
2002/0049084 A1 4/2002 Hughs-Baird et al.
2002/0059252 A1 5/2002 Yamaguchi
2003/0013519 A1 1/2003 Bennett
2004/0116173 A1 6/2004 Baerlocher

FOREIGN PATENT DOCUMENTS

EP 0688002 A1 12/1995
GB 2 096 376 A 10/1982
GB 2 097 160 A 10/1982
GB 2 100 905 A 1/1983
GB 2 137 392 A 10/1984
GB 2 142 457 A 1/1985
GB 2 144 644 A 3/1985
GB 2 153 572 A 8/1985
GB 2 161 008 A 1/1986
GB 2 161 009 A 1/1986
GB 2 170 636 A 8/1986
GB 2 180 682 A 4/1987
GB 2 181 589 A 4/1987
GB 2 183 882 A 6/1987
GB 2 222 712 A 3/1990
GB 2 226 436 A 6/1990
GB 2 226 907 A 7/1990
GB 2 262 642 A 6/1993
WO WO 00/12186 3/2000

OTHER PUBLICATIONS

Office Action dated May 21, 2003 for U.S. Appl. No. 09/682,408.
Office Action dated Dec. 22, 2004 for U.S. Appl. No. 10/832,729.
Office Action dated Jun. 27, 2005 for U.S. Appl. No. 10/832,729.
Office Action dated Jul. 31, 2006 for U.S. Appl. No. 10/919,971.
Golden Tee Golf game description(earliest version of Golden Tee Golf available in 1989), printed from http://en.wikipedia.org/wiki/Golden_Tee on Dec. 10, 2008.
Office Action dated Aug. 12, 2008 for U.S. Appl. No. 11/673,827.
Office Action dated Dec. 28, 2009 for U.S. Appl. No. 11/673,827, 9 pages.
Office Action dated Jul. 20, 2009 for U.S. Appl. No. 11/673,827, 9 pages.

Office Action dated Feb. 18, 2009 for U.S. Appl. No. 11/673,827, 9 pages.
Office Action dated Aug. 12, 2008 for U.S. Appl. No. 11/673,827, 8 pages.
Cash Chameleon Article written by Aristocrat Technologies, published Apr. 2001.
Description of Gaming Machine with Animating Symbols, written by IGT, available prior to Aug. 31, 2000.
Description of Poker written by Hoyle's Rules of Games, published 1946-1983.
Elvis Brochure and Elvis Article by IGT, Published 1999.
Fey, Slot Machines, A Pictorial History of the First 100 Years, Liberty Belle Books, 1983, pp. 215, 219.
gscentral.net, "Roll that Board", Sep. 19, 1982, http://gscentral.net/board.htm.
I Love Lucy—Episode Guide (website) written by www.tvtome.com, printed Dec. 9, 2003.
I Love Lucy—Season Two: 1952-53 (website) written by http://classicsitcoms.com, printed Dec. 9, 2003.
Introducing the Hottest Video Games on the Nile written by Aristocrat Technologies, published Oct. 2000.
Jackpot Party Brochure and Article published by WMS Gaming Inc. in 1998.
Job Switching ("Candy Factory") (website) written by www.youns.com, printed Dec. 9, 2003.
*Mikohn Ripley's Believe It or Not Article written by Strictly Slots published in 2001.*
Mountain Coin Machine Distributing—Redemption Games—CycloneTM from www.mountaincoin.com printed Feb. 28, 2002.
Ottinger et al., "Press Your Lunch", Sep. 19, 1983, Original Game Show Page.
Press Your Luck Article by Strictly Slots, dated 2000.
Primetime Amusements Redemption Games from www.primetimeamusements.com printed on Feb. 28, 2002.
Reel em In—Cast for Cash Brochure & Website published by WMS Gaming, Inc., dated in the year 2001, on or before December thereof.
Slotto Article by Strictly Slots, dated in the year 2001, on or before December thereof.
The Inside Straight article written by IGT, published in 2002, on or before December thereof.
Tickets'n'Tunes from www.rgb.com printed on Feb. 28, 2002.
Top Dollar Brochure written by IGT published in 1998, on or before December thereof.
Weiner Distributing ICE CycloneTMf from www.winerd.com. printed on Feb. 28, 2002.
Winning Bid Brochure published by WMS Gaming, Inc., dated in the year 2001, on or before December thereof.

* cited by examiner

GAMING DEVICE HAVING PERCEIVED SKILL

PRIORITY CLAIM

This application is a divisional application of and claims priority to U.S. patent application Ser. No. 10/832,729, filed on Apr. 27, 2004, which is a divisional application of and claims priority to U.S. patent application Ser. No. 09/682,408, filed on Aug. 30, 2001, now U.S. Pat. No. 6,761,632, which in turn claims priority to U.S. Provisional Patent Application Ser. No. 60/229,409, filed on Aug. 31, 2000, the entire contents of which are incorporated herein.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having a bonus round wherein a player's skill at an event or action determines or appears to determine when the player wins an award.

BACKGROUND OF THE INVENTION

Gaming machines are generally games of luck, not skill. Slot machines owe much of their popularity to the fact that a player can play a slot machine at the player's own pace with no required skills. Most slot machines are set to pay off between 80 and 99 percent of wagers of the players. Nevertheless, players constantly try to inject skill or know-how into gaming devices with the hope of turning the odds in their favor.

For example, there is a consensus as to good and bad slot machine locations. Some players believe that, the worst slot machines for the player are the machines near the gaming tables, such as blackjack, baccarat, roulette, etc. because the players of these games do not want to be distracted by the noise and commotion created by big slot machine winners. Some players believe that, for the same reason, machines near patrons betting on sporting events and horse races are not good. Some players believe that the best machines are those that are the most visible to others so that other players, or potential players, can see big payouts. Some players believe that the machines near cafes or coffee shops are rumored to be good to encourage patrons to finish quicker and return to gaming. Some players believe that machines near change booths supposedly have higher instances of big payouts to entice people in line purchasing tokens to buy more.

Another widely held belief is that slot machines go through a pay cycle, wherein the machines will payout a number of coins to meet the programmed percentage payout after a predetermined period. Players that believe a pay cycle exists may also believe that a non-payout cycle exists, wherein the machine does not payout after a big payout or a pay cycle. The object of players subscribing to these cycle theories is to play the machines at the right time.

However, it should be appreciated that gaming machines or slot machines are programmed or set to randomly pay back a certain percentage. There are certain known methods to maximizing gaming device payouts. One such method, for instance, is betting the maximum amount which increases the payouts.

Having a gaming machine truly based on skill would open the door to players becoming professionals at such games. Gaming devices of skill would also prejudice unskilled players, and unskilled players would be reluctant to play such games. Even though certain gaming machines such as video poker or blackjack involve certain skill and decision-making, their outcomes ultimately turn upon mathematics and probability. Accordingly, to increase player enjoyment and excitement, it is desirable to provide players with new gaming machines and bonus rounds for gaming machines that are different, challenging and appealing. In particular, it is desirable to provide players with gaming machines and bonus rounds for gaming machines wherein it appears as if the player's skill at a particular game determines the player's success.

SUMMARY OF THE INVENTION

The present invention overcomes the above shortcomings by providing a gaming device and preferably a bonus round of a gaming device, wherein a player's skill at an action or event determines the timing of the player's success in one embodiment and appears to determine a player's success in another embodiment. However, the results are based on probabilities or a predetermined result. In particular, the gaming device of the present invention includes a database which maintains a predetermined number of successful attempts, and the game enables the player's skill to activate, or appear to activate, a successful attempt.

The action or event preferably involves skill which requires the player to perform one or more acts. The skill can also involve certain criteria or criterion for the player to perform such acts. For instance, the game can require the player to estimate the timing of an action and/or the game can require the player to aim at an object or estimate the direction necessary to successfully produce a result.

In one embodiment described below, the game presents a plurality of targets moving in a line and a gun aiming in a circular or similar pattern at the line. The player does not move the gun; rather, the machine moves the gun in the circular or similar pattern, and the player estimates the time necessary for a bullet to travel to hit a bottle that will move slightly within that time period. To enhance the skill element of the embodiment, the game provides crosshairs or a projection of the bullet onto the plane in which the bottles move. The game provides a predetermined number of successful hits; if the player misses the target, the game provides the player with an additional chance to hit the target. Thus, the player will receive the same award without regard to the player's actual skill. The player's skill determines the timing of the award.

In another example of the same embodiment, the game provides a fixed target, a basketball backboard, which the game shows at different angles or positions. The game requires the player to rotate a pair of hands holding a basketball to correctly aim at the current position of the backboard before shooting the ball. In both the examples, the game determines through software adapted to judge the player's timing or aiming whether the player's shot actually hit the target. In this embodiment, the player's skill at an action determines when the player is successful.

The player's skill affects the timing of the award; however, the number of awards or successful results is predetermined and the value of the award is randomly generated. The game predetermines that the player will be successful a certain number of times. The predetermined number of successful outcomes is displayed to the player as bullets, basketballs, or some indicia relating to a theme. The game therefore only decreases the players opportunities (i.e., such as the remaining number of bullets or basketballs) when the player is successful. The bonus round ends when all the successful outcomes or opportunities are exhausted.

In another embodiment described below, the player's skill only appears to determine when the player is successful. In this embodiment, the game prompts the player to choose from a plurality of targets such as turkeys, and provides crosshairs that move in a pattern around the area of the target, sometimes appearing to be aiming at the target and sometimes not. The player most likely chooses a target having crosshairs that appear to be aiming at the target attempting to be successful. The game, however, does not activate a successful outcome based upon the location of the crosshairs; rather, the game randomly determines when to activate a successful outcome.

Upon the occurrence of a successful outcome such as a broken bottle, a made basket, or a shot turkey, the game preferably randomly selects an award from an award database. The game can select from the same award upon each successful result or maintain different awards for each successful result. When a particular award is provided, the game does not replace or remove the award from the award database, so that the game can randomly choose the same award over and over. The award database preferably contains gaming device credits or credit multipliers. Alternatively, the game can award any item of value to the player such as a number of picks from a bonus selection group.

The award database may also contain wildcards. A wildcard is preferably awarded in addition to credits or multipliers and functions to switch or change the award database of the bonus round to a more valuable award database. The game also preferably alters the bonus game displayed to the player. For example, in the shooting game embodiment, the game changes the target from a row of moving beer mugs to a row of moving liquor bottles upon receipt of a wildcard. Hitting any of the liquor bottles yields more credits or multipliers than hitting any of the beer glasses.

Each embodiment of the present invention preferably contains similar components including: a display device in communication with the gaming device controller; a player interface; an outcome determiner, which preferably includes an attempt-producing device, an attempt or action and at least one object effected by the attempt or action; and a plurality of indicators, such as an attempts remaining indicator or an award meter. The display device can include a touch screen and the player interface. The player interface can alternatively be externally mounted to a panel of the gaming device and preferably includes one or more digital inputs necessary to aim or shoot or otherwise perform the action requiring skill.

The player interface inputs one or more signals into the controller, and the controller responds by altering an attempt-producing device on the display device. The attempt-producing device is the gun or hands and basketball. The attempt-producing device produces or originates the attempt or action. The attempt or action can include a display of a moving object such as the basketball or can include a visual and audio display of an effect on the attempt-producing device and the object effected by the attempt. For example, the attempt or action can include a burst of fire and a gunshot sound from the gun and a glass/bottle shattering or features flying and their associated sounds.

The bottles, backboard and turkeys described above are examples of objects effected by the action. The predetermined result dictates which effect the game shows, i.e., a glass breaking/no glass breaking, flying turkey feathers/turkey in tact or a basketball traveling through the net/bouncing off the rim of the backboard. A successful result and display also includes an update and display of additional credits or multipliers in the award meter. The game predetermines the number of successful results, which is equal to a number of bullets or basketballs, etc. given to the player. When the player successfully shoots a target or basket, the game removes a bullet or basketball from the display.

It is therefore an object of the present invention to provide a gaming device with a bonus round that includes an action or event requiring skill, wherein the skill element of the round determines when the player is successful and achieves an award.

Another object of the present invention is to provide a gaming device with a bonus round that includes an action or event requiring skill, wherein the skill element of the round appears to determine whether the player is successful and achieves an award.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Figure 1:
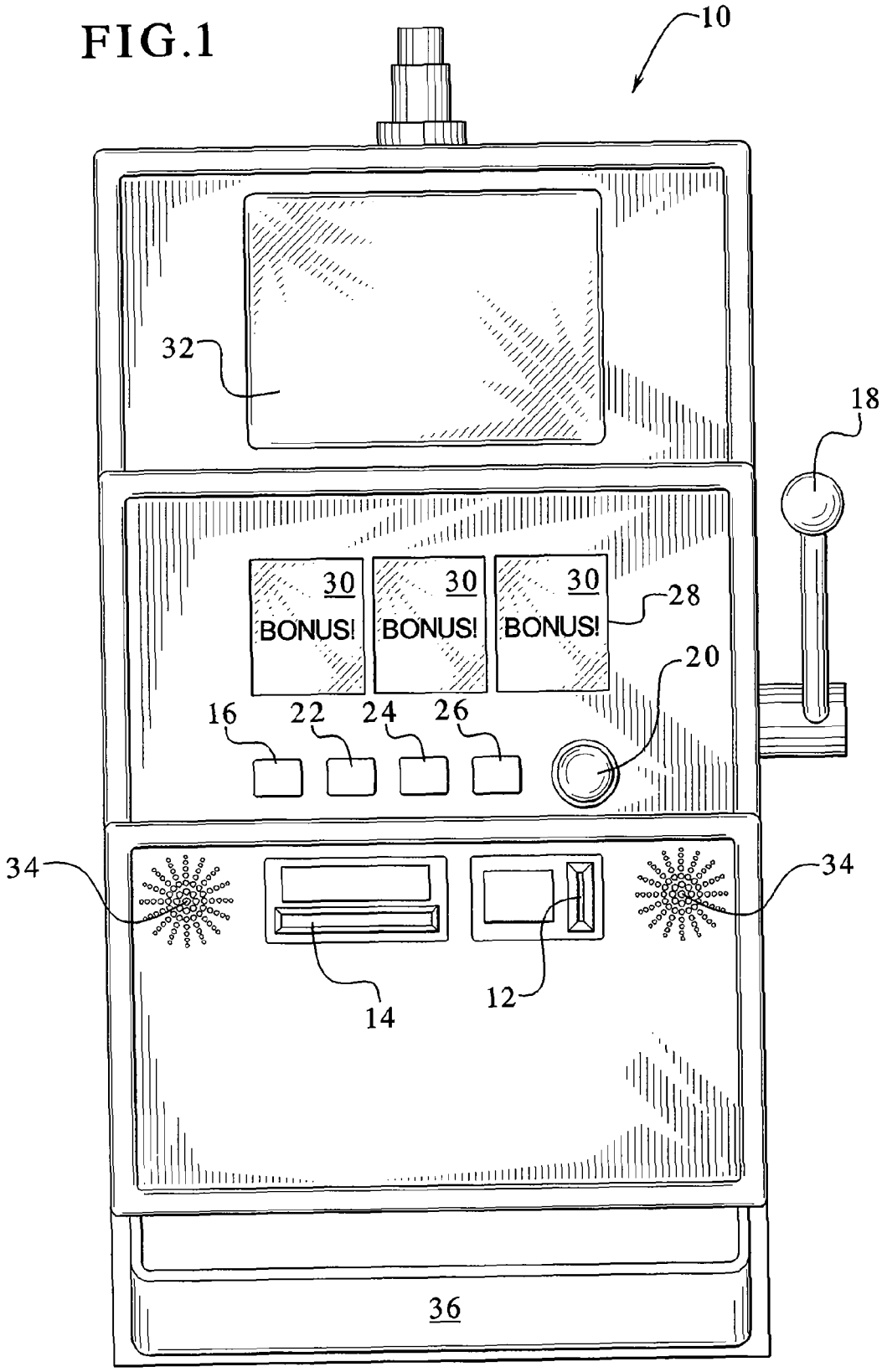
FIG. 1 is a front elevational view of one embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown), which a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any game such as slot, poker or keno in addition to a bonus triggering event that triggers the bonus round of the present invention. The symbols and indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling the arm 18 of pushing the play button 20. Play button 20 can be any play activator used by the player which starts any game or sequence of events in the gaming device.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

Gaming device 10 also has a paystop display 28 that contains a plurality of reels 30, preferably three to five reels in mechanical or video form. Each reel 30 displays a plurality of indicia such as bells, hearts, fruits, numbers, letters, bars or other images which preferably correspond to a theme associated with the gaming device 10. If the reels 30 are in video form, the gaming device 10 preferably displays the video reels 30 at display device 32 instead of at the paystop display 28. Furthermore, gaming device 10 preferably includes speakers 34 for making sounds or playing music.

At any time during the game, a player may "cash out" and thereby receive a number of coins corresponding to the number of remaining credits by pushing a cash out button 26. When the player "cashes out," the player receives the coins in a coin hopper 36. The gaming device 10 may employ other payout mechanisms such as credit slips redeemable by a cashier or electronically recordable cards that keep track of the player's credits.

Figure 2:
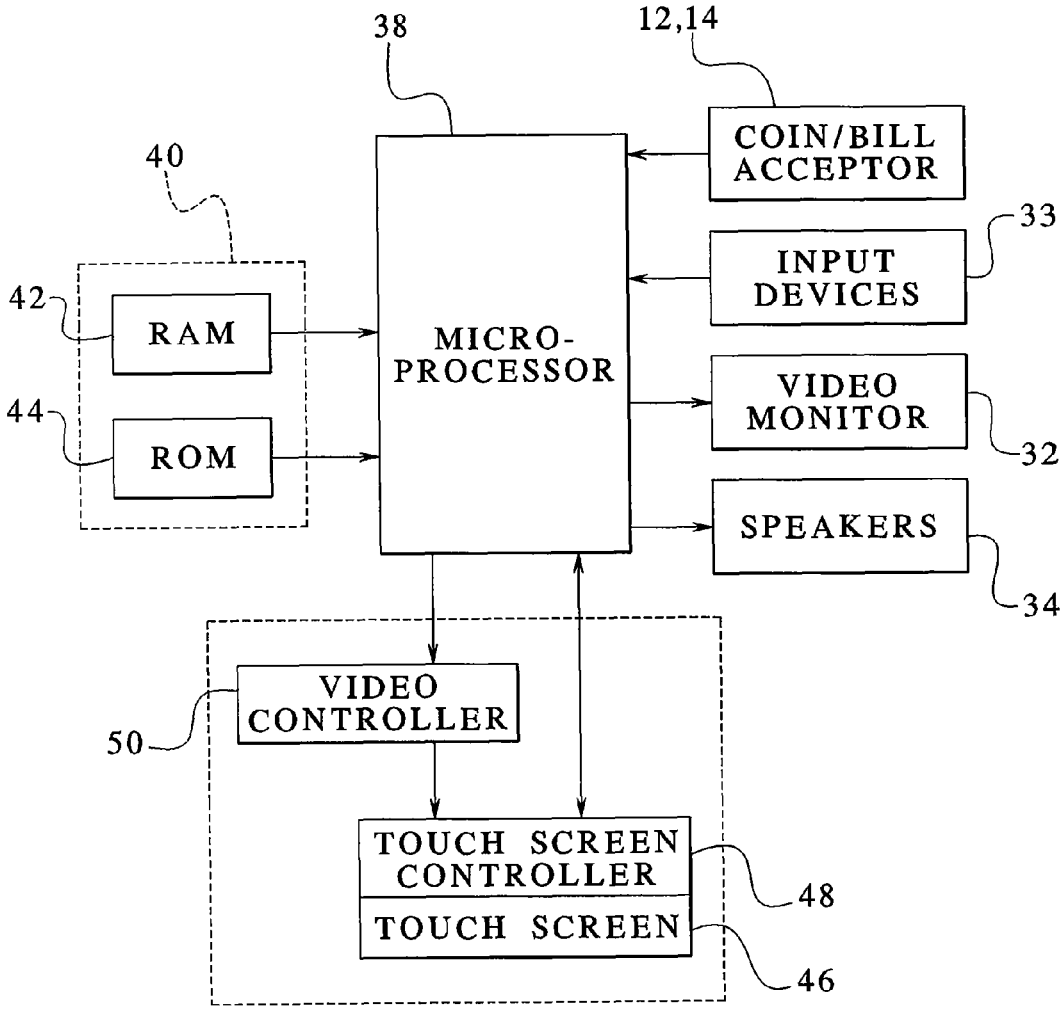
FIG. 2 is a schematic block diagram of the electronic configuration of one embodiment of the gaming device of the present invention.

With respect to electronics, the controller 100 of gaming device 10 preferably includes the electronic configuration generally illustrated in FIG. 2, which contains: a processor 38; a memory device 40 for storing program code or other data; a display device 32 or other display device (i.e., a liquid crystal display); a plurality of speakers 34; and at least one input device as indicated by block 33. The processor 38 is preferably a microprocessor or microcontroller-based platform that is capable of displaying images, symbols and other indicia such as images of people, characters, places, things and faces of cards. The memory device 40 can include random access memory (RAM) 42 for storing event data or other data generated or used during a particular game. The memory device 40 can also include read only memory (ROM) 44 for storing program code which controls the gaming device 10 so that it plays a particular game in accordance with applicable game rules and pay tables.

As illustrated in FIG. 2, the player preferably uses the input devices 33, such as the arm 18, play button 20, the bet one button 24 and the cash out button 26 to input signals into gaming device 10. Furthermore, it is preferable that touch screen 46 and an associated touch screen controller 48 are used instead of a conventional display device 32. Touch screen 46 and touch screen controller 48 are connected to a video controller 50 and processor 38. A player can make decisions and input signals into the gaming device 10 by touching touch screen 46 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. For purposes of describing the invention, the controller includes the processor 38, the memory device 40 and all the components displayed in FIG. 2.

With reference to FIGS. 1 and 2, to operate the gaming device 10, the player must insert the appropriate amount of money or tokens at coin slot 12 or bill acceptor 14 and then pull the arm 18 or push the play button 20. The reels 30 will then begin to spin. Eventually, the reels 30 will come to a stop. As long as the player has credits remaining, the player can spin the reels 30 again. Depending upon where the reels 30 stop, the player may or may not win additional credits.

In addition to winning credits in this manner, gaming device 10 also preferably gives players the opportunity to win credits in a bonus round. This type of gaming device 10 will include a program that will automatically begin a bonus round when the player has achieved a qualifying condition in the game. This qualifying condition can be a particular arrangement of indicia on the display window 28. The gaming device 10 also includes a display device such as a display device 32 shown in FIG. 1 enabling the player to play the bonus round. Preferably, the qualifying condition is a predetermined combination of indicia appearing on a plurality of reels 30. As illustrated in the three reel slot game shown in FIG. 1, the qualifying condition could be the text "BONUS!" appearing in the same location on three adjacent reels.

Figure 3:
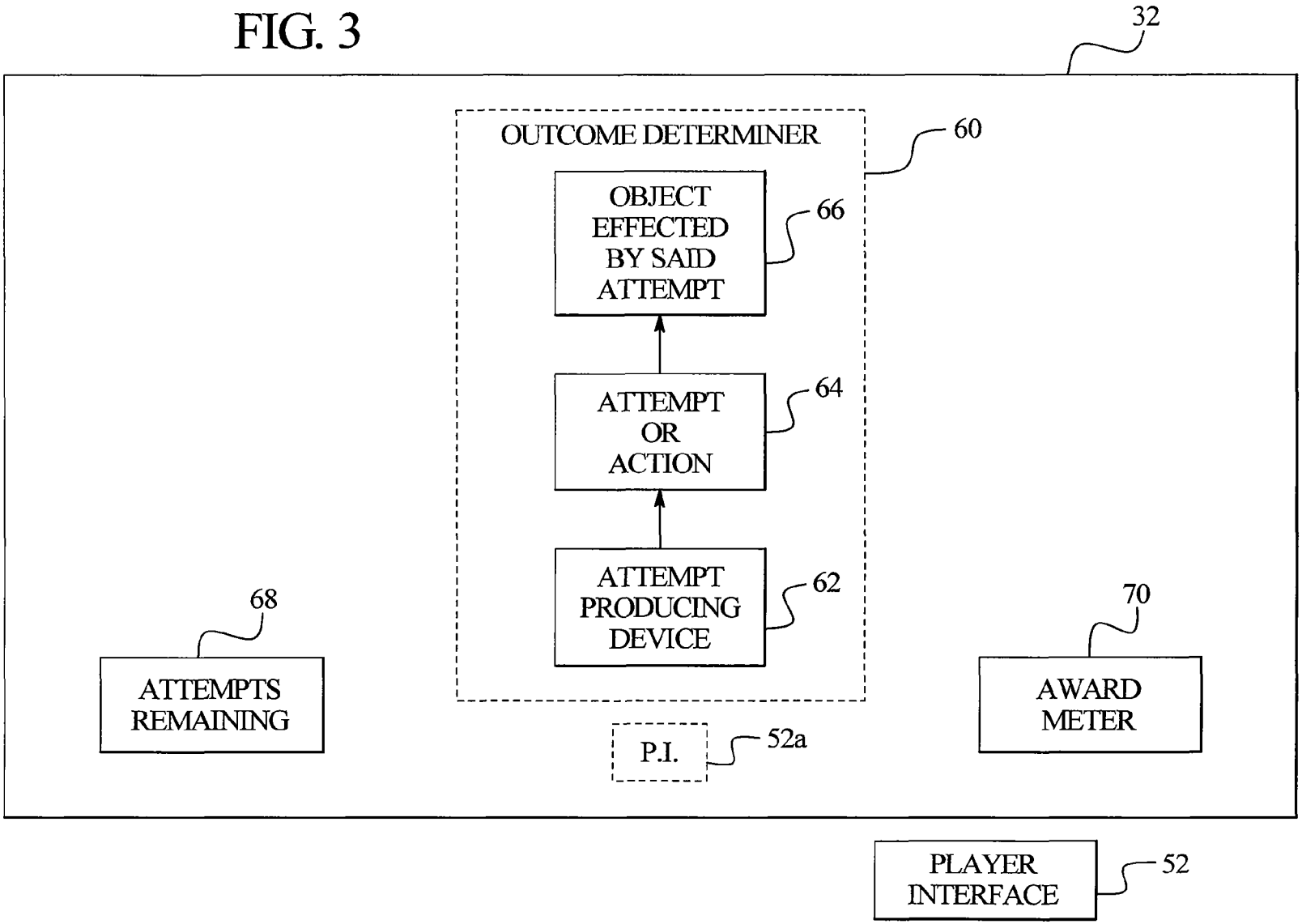
FIG. 3 is a schematic diagram of the display device having the components of the present invention.
Figure 4:
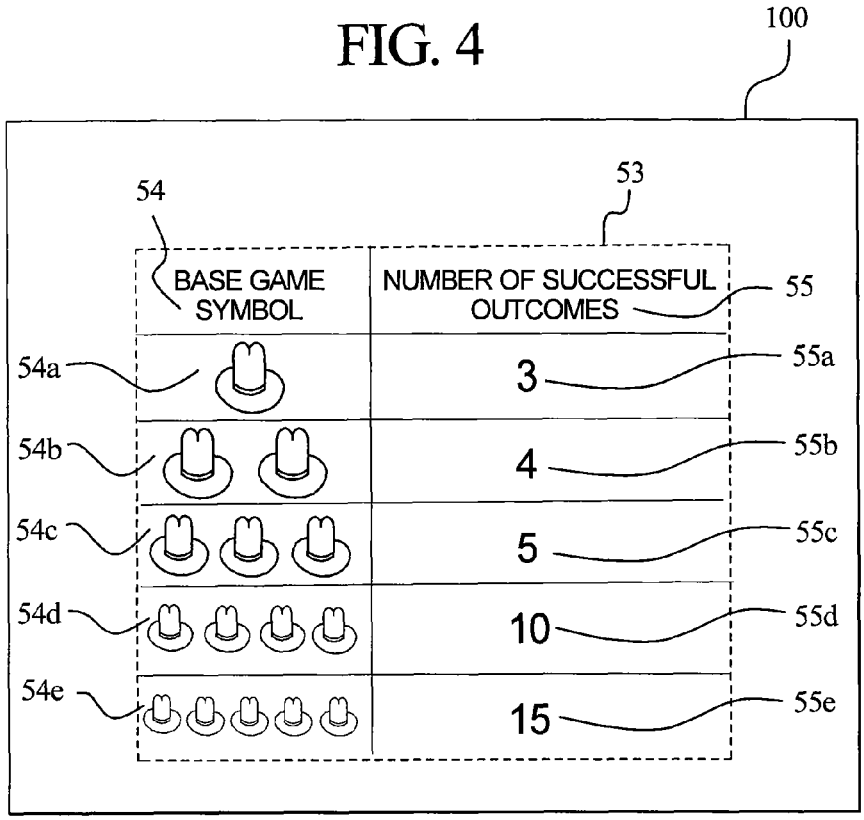
FIG. 4 is a schematic diagram of a database contained in the controller of the present invention having different successful outcomes for different combinations of base game symbols.
Figure 5:
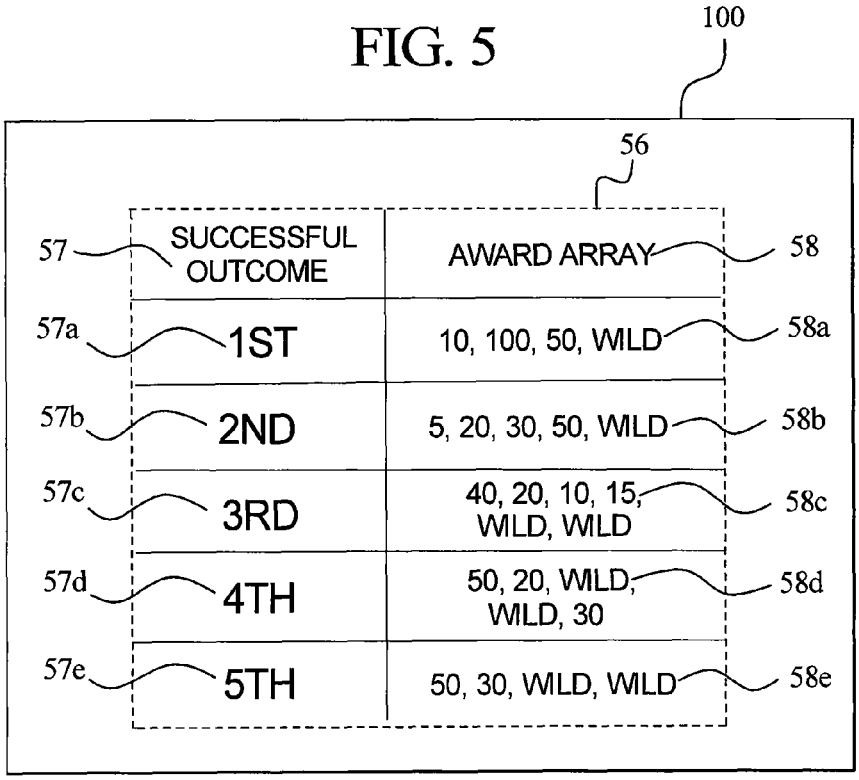
FIG. 5 is a schematic diagram of a database contained in the controller of the present invention having different award arrays for different successful outcomes.

Referring now to FIGS. 3, 4 and 5, schematic layouts of the components of the present invention are shown, wherein there are three primary components; namely, the bonus round player interface 52, the display device 32 and the controller 100 as described above. Each of these primary components can have different configurations and/or sub-components.

Referring to FIG. 3, a schematic diagram of the display device 32 is shown having a player interface 52. The player interface 52 can have different configurations depending upon the particular embodiment of the invention. In one embodiment, the player interface 52*a* is an input on a touch screen 46 of the display device 32. The touch screen player interface 52*a* preferably employs digital inputs such as a pushbutton or a plurality of such pushbuttons. The present invention can configure the pushbuttons so that if a player maintains the pushbutton, e.g., presses an arrow for an extended time period, the controller receives a series of digital inputs. The maintainable pushbutton enables the player to steer, direct or aim an item from the touch screen 46.

If the player interface 52 is not included on a touch screen 46, then the present invention provides an external input device 33 (FIG. 2), shown in FIG. 3 as the player interface 52. The external player interface 52 is mounted on the gaming device 10 in a suitable location as desired by the implementor. The configuration of the external player interface 52 is the same as the touch screen player interface 52*a*, except the external interface employs mechanical devices, while the touch screen interface is simulated.

The external player interface 52 preferably employs digital input devices such as a pushbutton or a plurality of such pushbuttons. The present invention can also configure the mechanical pushbuttons so that if a player maintains the pushbutton, e.g., presses an arrow for an extended time period, the controller receives a series of digital inputs. The maintainable pushbutton enables the player to steer, direct or aim an item from the gaming device 10. It should be appreciated that the present invention can employ other external input devices besides pushbuttons, such as toggle switches, joysticks or digitizers, etc.

Referring now to FIG. 4, the controller 100 of the present invention is shown containing a success table or database of information generally indicated by the number 53. The success database 53 defines the number of successful outcomes that the player has in the bonus round. The success database 53 has a symbol column 54 containing a plurality of symbols any one of which invokes the bonus round, namely, the symbols 54*a* through 54*e*. The symbols 54*a* through 54*e* can be any single symbol or combination of symbols. The symbols preferably correspond to a game theme and are shown here as one or more cowboy hats.

The success database 53 contains a success number column 55 containing a number 55*a* through 55*e* corresponding to each of the symbols 54*a* through 54*e*. The game preferably provides a higher success number 55 for a less probable symbol combination 54. It should be appreciated that obtaining a plurality of required symbols is less likely than obtaining one required symbol. The gaming device 10 randomly determines the number of base game symbols. As shown in the success database 53, the more symbols 54 or hats required, the more successful outcomes 55 the game gives to the player. The gaming device 10 predetermines a number of successful outcomes 55 based on the number of randomly determined base game outcomes. The game can alternatively assign the success number 55*a* through 55*e* randomly or in accordance with a game theme.

In an alternative embodiment, the game could award the same number of successful outcomes 55 each time the player enters a bonus round. That is, gaming device 10 could completely predetermine the number of successful outcomes. Further alternatively, the game could base the number of successful outcomes 55 upon some basis other than base game symbols, such as the number of paylines played or whether the player has wagered a maximum allowable amount. It should be appreciated that the number of successful outcomes may be completely randomly determined, completely predetermined or be determined through a random component (generate base game symbols) and a predetermined component (provide outcomes based on number of randomly determined base game outcomes).

Referring now to FIG. 5, the controller 100 of the present invention is shown containing another table or database of information, generally indicated by the number 56. The award database 56 contains an award array 58 for each sequential successful outcome 57 in the bonus round. The award database 56 shows a different award array 58*a* through 58*e* for each successive successful outcome 57*a* through 57*e*. Alternatively, the game may employ one award array 58 for every successful outcome 57 or repeat a plurality of award arrays 58. When the game provides only one award array 58 for each successful outcome such as outcomes 57*a* through 57*e*, the game does not exclude, remove or replace an award after the game has randomly selected it. That is, the game can select the same award more than once. The game preferably awards higher average values for later successful outcomes. Only successful outcomes invoke the award database 56. After the controller determines that an attempt is unsuccessful, no further decision making or random generation is required. The methods of such determination are discussed below.

The award arrays 58*a* through 58*e* for each successful outcome 57*a* through 57*e* respectively, contain two possible types of entries or constituents. The award arrays 58 contain numerical awards such as the 10, 50 and 100 shown in the award array 58*a*. A numerical award can represent any form of award such as a number of credits, a multiplier number that multiplies a number of gaming device credits or any other prize desired by the implementor such as a number of picks from a group of credit producing selections. The numerical awards can have any number desired by the implementor, such as the 10, 50 or 100 shown in the award array 58.

The award arrays 58 can also contain wild cards, wherein the game performs a function as defined in the particular embodiment. The implementor can define the function of the wild card to be any function in accordance with the game theme. In one embodiment, the wild card can change the award array 58 to one having higher payouts and change the display to one having a different competition and/or a higher stakes action or attempt. For example, in the shooting embodiment described below, the game switches targets from beer mugs to liquor bottles upon receipt of the wild card award. Hitting a liquor bottle invokes an award array having a higher average value than the beer mug award array and likely yields more points than hitting a beer mug.

Referring again to FIG. 3, a block diagram of the display device 32 is shown having an outcome determiner 60, which is generic to the present invention and is contained in each embodiment. The outcome determiner 60 is shown by the dotted lines containing three separate components of the overall display; namely, an attempt-producing device 62, an attempt or action 64 and an object or objects 66 effected by the attempt or action 64. While the outcome determiner 60 preferably contains all three display components, the present invention can provide an embodiment without the attempt-producing device 62.

The attempt-producing device 62 is that portion of the overall display, wherein the attempt or action 64 originates and is preferably the cause or source of origination for the attempt or action 64 as seen on the display. The player interface 52 communicates with the controller 100, which causes the display to show the attempt-producing device 62 produce the attempt 64. Preferably, the player interface 52 determines the time when the attempt or action occurs. Alternatively, the present invention can also enable the attempt-producing device 62 to move or aim or otherwise respond to the player's use of the player interface 52.

The attempt 64 is preferably an action in a game of skill. The implementor can choose any game of skill and any action within that game. In the embodiments described below, the actions include the shooting of one or more objects such as a gun or basketball. The present invention can display as much of the action, including any associated sounds, that is necessary to illustrate a successful or failed attempt. For example, the gun embodiment preferably does not show a bullet moving, but the basketball embodiment can show the flight of the ball.

Each embodiment of the present invention preferably displays an object or objects 66 effected by the attempt 64. One effect upon the object 66 preferably depicts success, while another effect upon the object 66 depicts failure. It should be appreciated that no effect upon the object could depict either success or failure depending upon the action or attempt 64. For example, in an embodiment involving a motorcycle daredevil attempting to jump a plurality of school buses, the lack of a fiery crash signals success and an award.

Referring still to FIG. 3, the generalized schematic of the display device also contains two indicators not included within the outcome determiner 60; namely, a successful outcome indicator 68 and an award meter 70. The successful outcome indicator 68 informs the player as to how many successful outcomes 57, of the award database 56 remain unactivated. The game preferably provides a suitable visual display showing the remaining successful outcomes 57 in accordance with the theme created by the outcome determiner 60. The award meter 70 displays an update of the player's total accumulated award (i.e., summation of selected entries from the award arrays 58) for successful outcomes, as the player proceeds through the round. It should be appreciated that the present invention can provide any other suitable display such as the credit display 16, which displays the player's total accumulated credits.

Bonus Round Sequence

Figure 6:
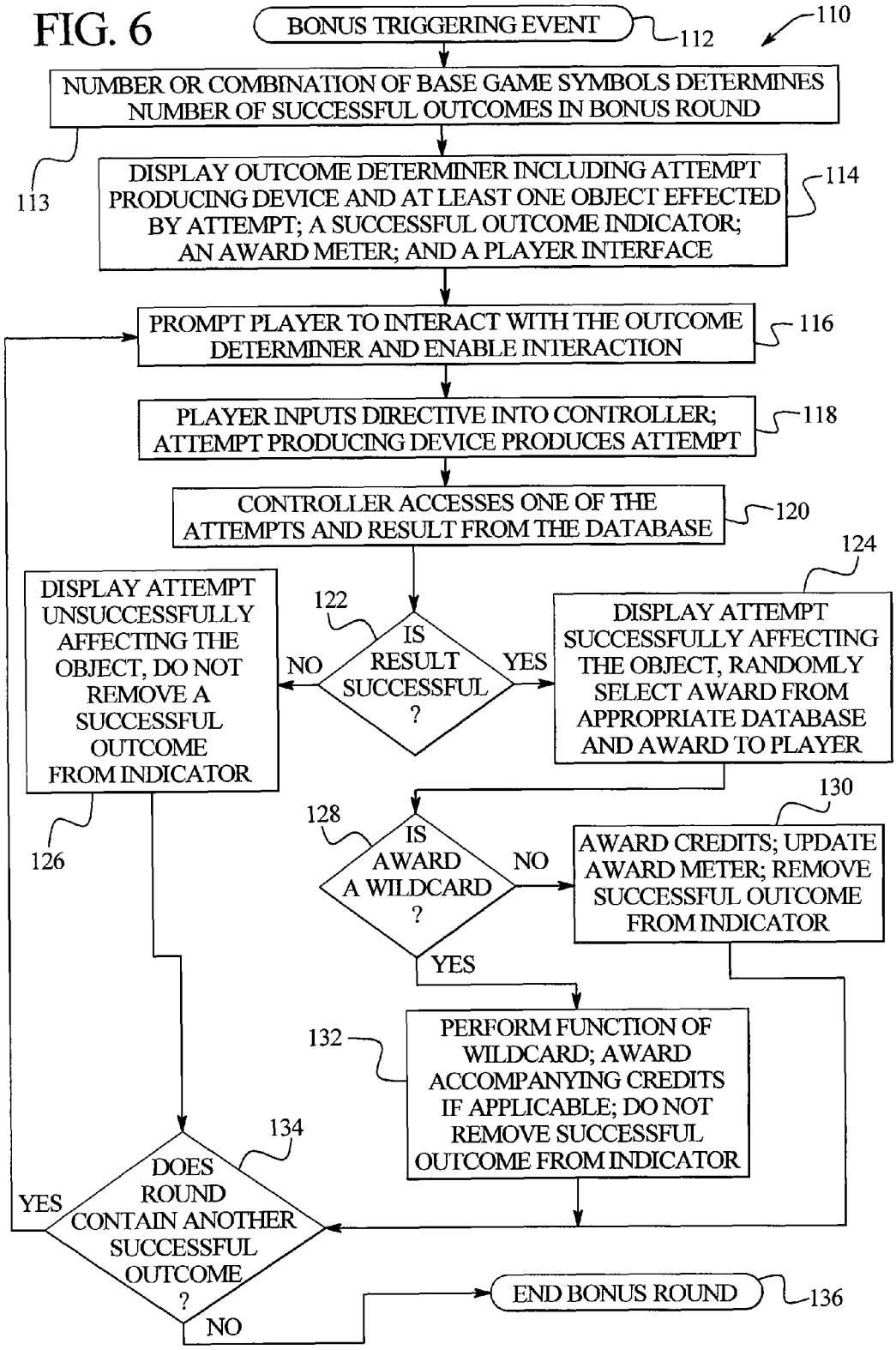
FIG. 6 is a flow diagram of the sequence of operation the present invention.

Referring now to FIG. 6, a flow diagram of the sequence of operation of the present invention generally indicated by the number 110 is shown. Upon a bonus round triggering event indicated by oval 112, the game determines a success number (e.g., 55*a* through 55*e* in FIG. 4) based on the symbol combination (e.g., 54*a* through 54*e* in FIG. 4) that has triggered the bonus round, as indicated by block 113. The gaming device initiates the bonus round by providing a bonus round display preferably having an outcome determiner 60, a successful outcome indicator 68 and an award meter 70, as indicated by block 114. The outcome determiner 60 preferably contains an attempt-producing device 62 and at least one object 66 effected by the attempt. Either the touch screen display displays or the gaming device includes a player interface 52*a* or 52, respectively.

The gaming device enables the player to initiate action with the outcome determiner 60. The game provides suitable audio and visual displays to prompt the player to interact with the outcome determiner 60, as indicated by block 116. For example, the display device 32 can provide an arrow pointing to the touch screen player interface 52*a* or highlight it. Similarly, the gaming device can highlight the external player interface 52. In both situations, the gaming device can place a suitable message on the player interface, such as, "SHOOT." In both situations, the game can also provide suitable audio inducements, such as, "Go ahead, take your best shot, partner."

When the player inputs a directive into the controller via the player interface 52, the controller 100 responds by having the attempt-producing device 62 produce the attempt or action 64, as indicated by block 118. In the embodiment wherein the player's skill determines the outcome of an attempt 64, the controller 100 determines whether the action or attempt actually affects the object 66 in a way that invokes one of the successful outcomes. In a gun shooting embodiment, the controller determines if the crosshairs of the gun are within a measure of tolerance from the target. If the crosshairs are, for example, within ⅛ inch of the target, the controller activates a successful outcome. If not, the controller enables the player to make another attempt.

The controller displays, via the display, an attempt or action involving skill 64 affecting the object 66 in a way that succeeds or fails. If the result 58 is successful as determined in diamond 122, the game displays the attempt or action 64 successfully affecting the object 66, as indicated by block 124. When the attempt is successful, the controller 100 accesses the appropriate successful outcome (e.g., 57*a* through 57*e* in FIG. 5); randomly selects an award from the appropriate award array (e.g., 58*a* through 58*e* in FIG. 5) and awards such award to the player. If the result 58 is not successful as determined in diamond 122, the game displays the attempt or action 64 unsuccessfully affecting or not affecting the object 66 and does not remove one of the remaining successful outcomes from the indicator 68, as indicated by block 126. Thus, an unsuccessful attempt affects the timing of an award, but does not determine if the player ultimately receives an award. In the preferred embodiment of the present invention, the player ultimately receives an award for each successful outcome predetermined or determined randomly.

Pursuant to the display of the successful effect as indicated by block 124, if the award is not a wildcard of one of the award arrays 58, as determined in diamond 128, the game updates the award meter 70 by adding a numerical award and subtracts one of the successful outcomes 57 from the successful outcome indicator 68, as indicated by block 130. If the award includes a wildcard, the game performs the function of the wildcard, which preferably includes activating a higher average value award array 56 and can additionally include an accompanying game credit or modifier award, as indicated by block 132. If the award includes a wildcard, the game does not preferably remove one of the successful outcomes from the indicator 68, but the game will update the award meter 70 if an award accompanies the wildcard.

If the bonus round contains another successful outcome in the award database 56, as determined in diamond 134, the game enables the player to initiate action with the outcome determiner 60 for the next attempt, as indicated by block 116. If the bonus round does not contain another successful outcome in the database 56, as determined in diamond 134, the game ends the bonus round, as indicated by oval 136.

Figure 7A:
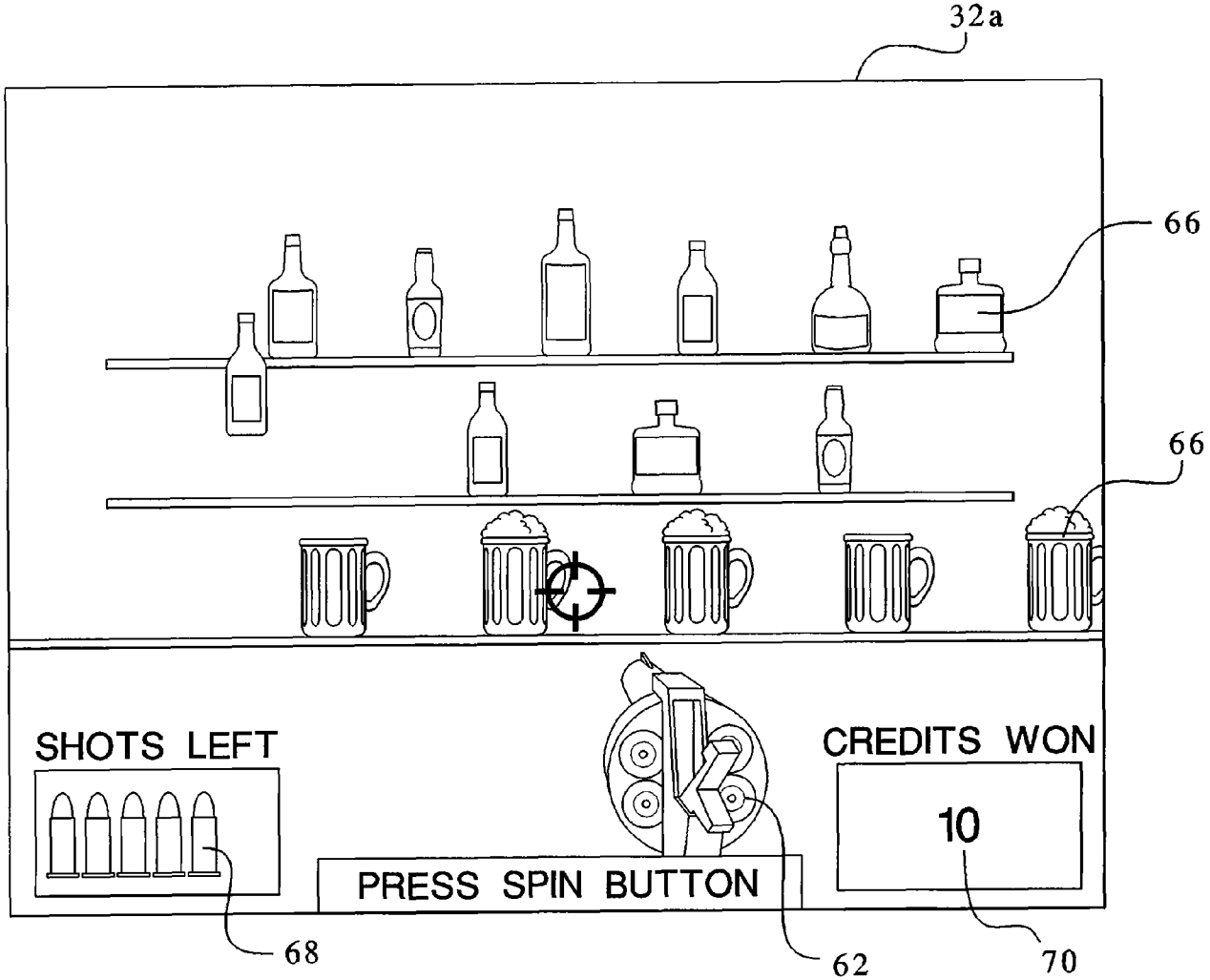
FIG. 7A is an enlarged front elevational view of the display device having a display of an example of one embodiment of the present invention, wherein the player's skill determines when the game provides an award.
Figure 7B:
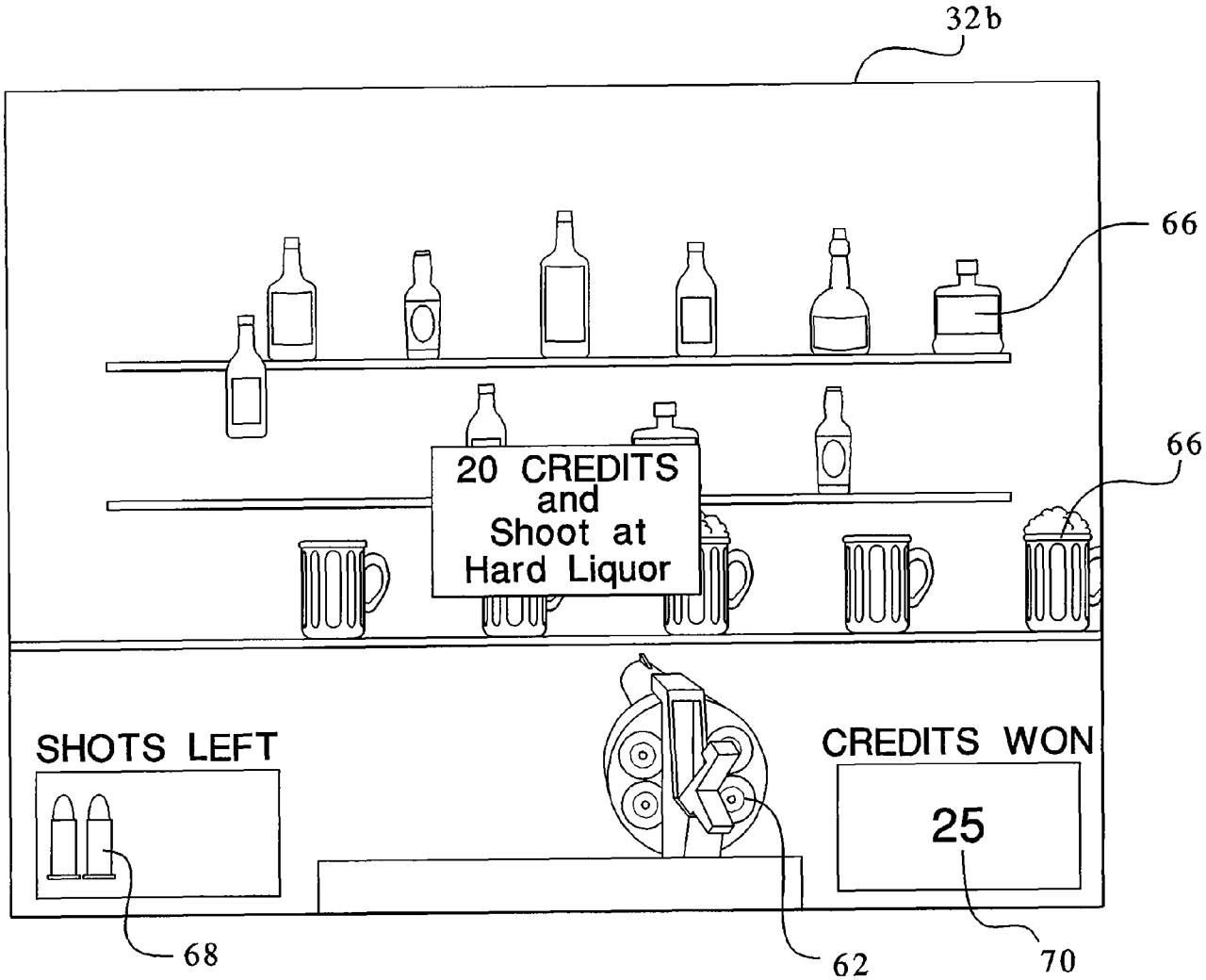
FIG. 7B is an enlarged front elevational view of the display device having another display of the example in FIG. 7A.
Figure 7C:
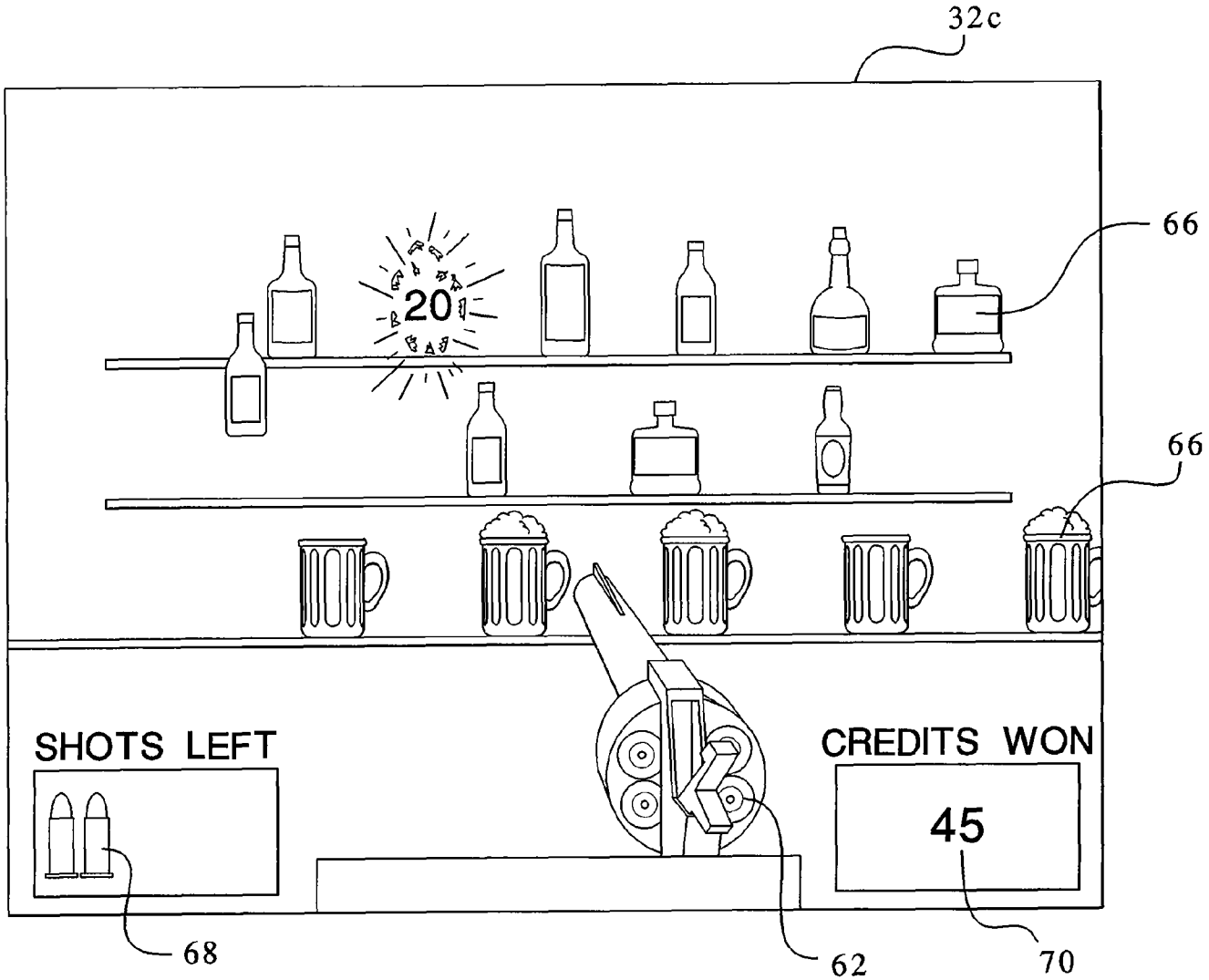
FIG. 7C is an enlarged front elevational view of the display device having a further display of the example in FIG. 7A.

Referring to FIGS. 7A through 7C, enlarged views 32*a* through 32*c* of the display device 32 are shown containing one embodiment of the present invention, wherein the player's skill at aiming or timing actually determines when the player will receive an award. Referring to FIG. 7A, upon a bonus round triggering event, the gaming device determines the number of successful outcomes the player has in the bonus round and provides a bonus round display 32*a* including an outcome determiner, a successful outcome indicator 68 and an award meter 70. The outcome determiner 60 also contains an attempt-producing device 62 and at least one object 66 effected by the attempt. In this embodiment, the display 32*a* does not contain a touch screen player interface 52*a*; rather, the gaming device contains an external player interface (not shown in FIG. 7A).

In this embodiment, the attempt-producing device 62 is a gun and associated crosshairs as shown. The crosshairs represent the location of the bullet, if fired, in the plane of the targets or objects. The objects 66 effected by the attempts are beer mugs and liquor bottles. The present invention preferably provides and displays a theme associated with the bonus round. In this embodiment, the theme includes a wild west saloon, wherein the player shoots at moving bottles to obtain points. The attempts 64 are shots and the game awards points when the player hits a mug or bottle.

The player interface directs tells the controller when to shoot. In this embodiment, the player doesn't aim the gun, rather, the bottles move and the gun and crosshairs move slightly in a circular pattern. The player has no control over the gun's aim at any given time. The skill involves timing, wherein the player shoots when the circular moving crosshairs are directly on or slightly ahead of the target. This embodiment, however, involves actual skill. As described above, the game is programmed to determine if the player has properly timed the input to shoot. The software looks to see if the crosshairs are within certain criteria or criterion such as a ⅛ inch tolerance around the mug or bottle at the time of input. The tolerance can be any distance, but the program software preferably makes hitting a mug or bottle relatively easy so that a player can play the bonus round in a relatively short period of time. The game can also include a maximum number of attempts limiter (not shown) that provides the player with many attempts, but ends or shortens the round in a situation where a player intentionally and successfully tries to miss.

The game provides suitable audio and visual displays to prompt the player to initiate an attempt or action, i.e., the game provides the "Press Spin Button" message. In this embodiment, the game employs the play or spin reels button 20 to serve as the player interface 52 in the bonus round. The game can alternatively employ a separate player interface 52. It should be appreciated that the game can employ a suitable audio message in accordance with the theme, such as, "Go ahead, take your best shot, partner."

The successful outcome indicator 68 includes bullets, wherein each bullet represents a remaining successful outcome 57. The award meter 70 includes the credits accumulated for hitting a glass or bottle. In screen 32*a* of FIG. 7A, the player has currently hit 10 credits worth of glasses or bottles.

Referring to FIG. 7B containing the screen 32*b*, the player has two bullets remaining in the successful outcome indicator 68 and has accumulated 25 points. The player has also hit a beer bottle object 66 that yielded the player a wildcard award from the award arrays 58 of the database 56 (FIG. 5). In this embodiment, the wild card enables the player to shoot at a higher award yielding set of moving liquor bottles. The display 32*b* provides a suitable signal to the player, i.e., "Shoot at hard Liquor." The database 56 in the controller preferably invokes an award array having a higher average award.

The game may contain multiple levels, wherein the player can receive wildcards to achieve each multiple level. The receipt of a wildcard preferably does not expend or exhaust one of the player's successful outcomes. In an alternative embodiment, the game can additionally award credits or multipliers when the player receives a wildcard award. The game can include an additional level of probability wherein if the player obtains the designated wildcard object sooner, the player obtains successful attempts having a higher average (i.e., from the liquor bottles).

Referring to FIG. 7C containing the display 32*c*, the game has changed the angle of the attempt-producing gun 62 to reflect the change of effected objects 66 from the lower award beer mugs to the higher award liquor bottles. The display 32*c* also shows the attempt or action 64, i.e., shooting a gun, affecting the object 66, the bottle. The display shows fragments of a bottle that an attempt or bullet has hit. The game also preferably provides the sound of a gunshot when the player hits the player interface 52 and the sound of a shattering bottle when the bullet hits the bottle. The visual and audio productions comprise the attempt or action 64. The game updates and displays the award randomly selected from an award database 56 (FIG. 5) in the credit meter 70.

Figure 8A:
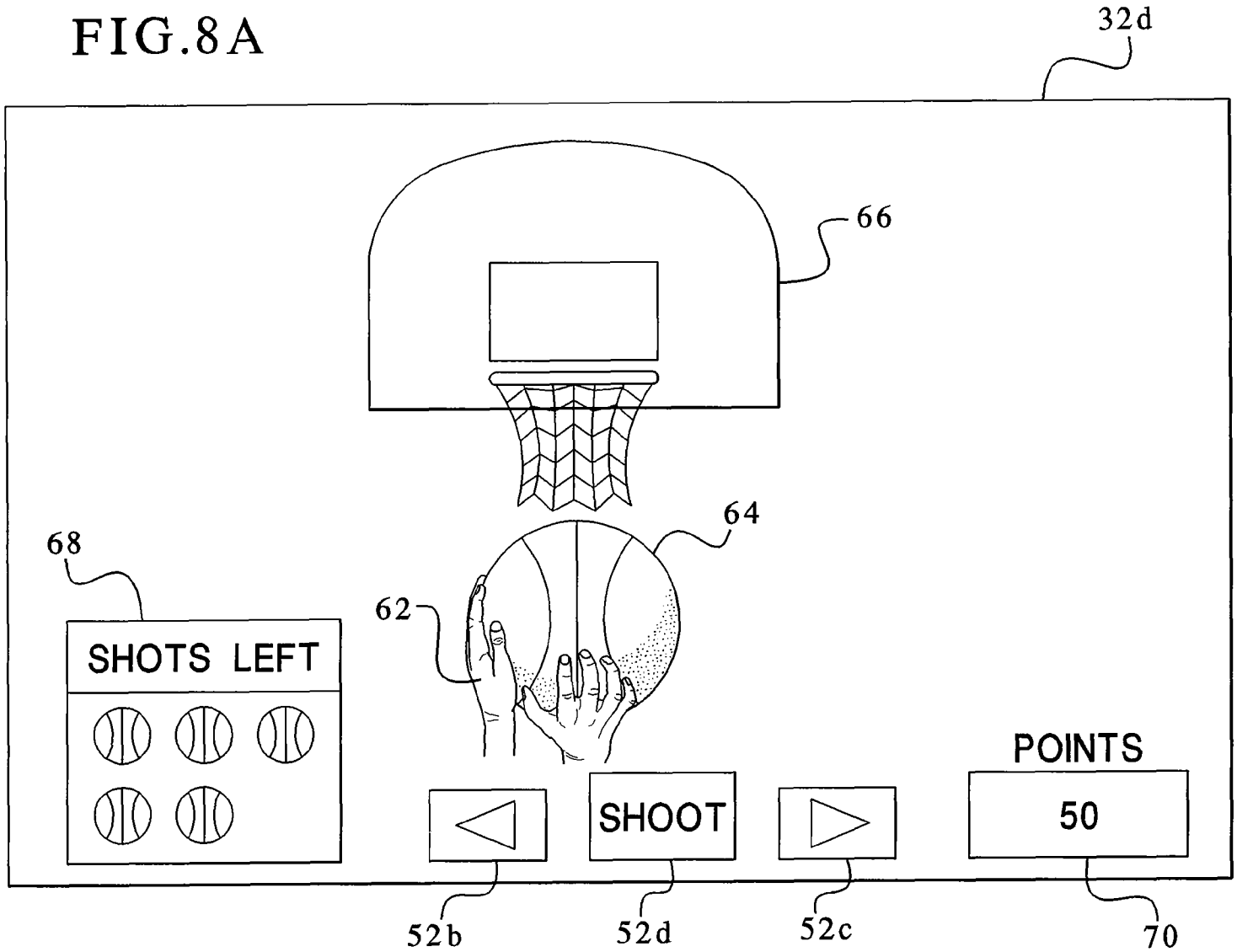
FIG. 8A is an enlarged front elevational view of the display device having a display of another example, wherein the player's skill determines when the game provides an award.
Figure 8B:
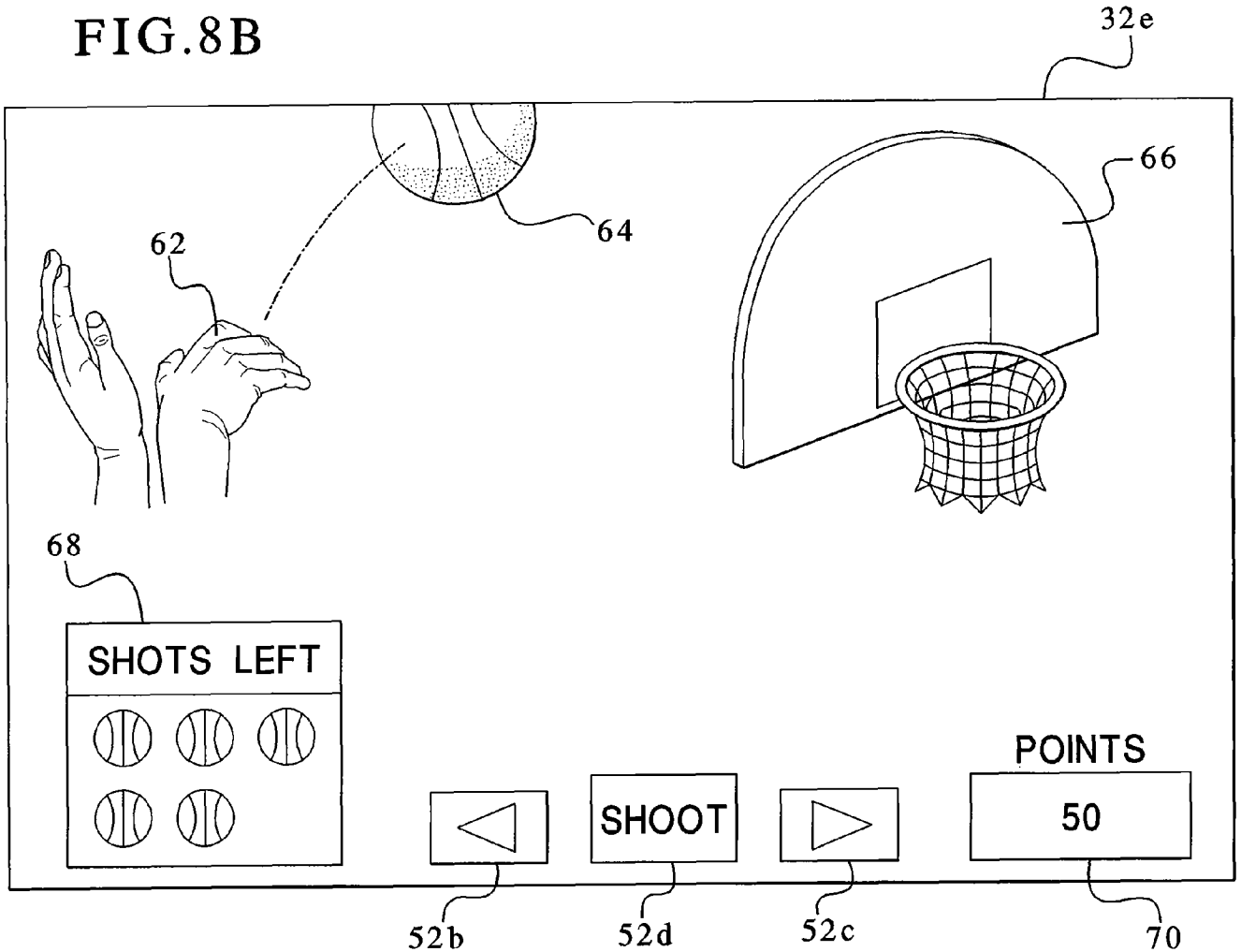
FIG. 8B is an enlarged front elevational view of the display device having another display of the example in FIG. 8A.
Figure 8C:
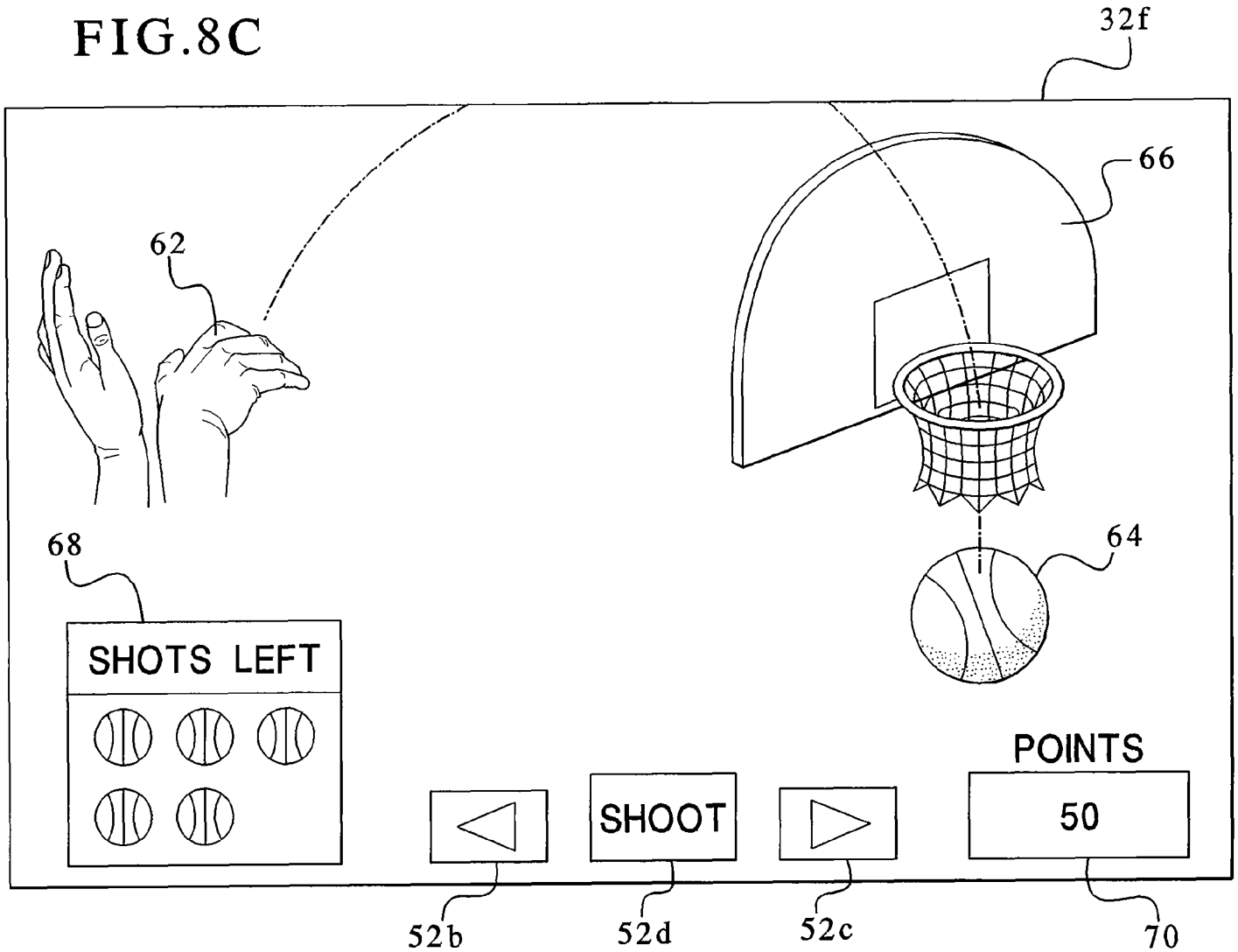
FIG. 8C is an enlarged front elevational view of the display device having a further display of the example in FIG. 8A.

Referring to FIGS. 8A through 8C, enlarged views 32*d* through 32*f* of the display device 32 are shown containing another example of the current embodiment, wherein the player's skill at an action actually determines when the player receives an award. Referring to FIG. 8A, upon a bonus round triggering event, the gaming device provides a bonus round display 32*d* having an outcome determiner, a successful outcome indicator 68 and an award meter 70. The outcome determiner contains an attempt-producing device 62 and an object 66 effected by the attempt. In this example, the display 32*d* contains a touch screen player interface 52*a* that has two directional buttons 52*b* and 52*c*, and a shoot button 52*d*.

In this example, the attempt-producing device 62 is a pair of hands holding a basketball in position to shoot the ball. The act of rotating or aiming the hands and shooting the basketball is the attempt or action 64 and the object 66 effected is the backboard and basket. The timing of the shot does not appear to the player to be critical in this embodiment; rather, the skill involves aligning the shooter's hands to face the basket. The game places the basket at different positions and angles on the display for different attempts. The successful outcome indicator 68 contains a number of basketballs equaling the number of remaining successful outcomes as determined in the successful outcome database 53 (FIG. 4) and by the number of base game symbols 54 (FIG. 4) that invoked the bonus round (i.e., the number of successful outcomes can be randomly determined or predetermined). The award meter 70 is a scoreboard that accumulates points for successful shots.

Referring to FIG. 8B containing the display 32*e*, an illustration of the skill element of this embodiment is displayed wherein the player must rotate the hands and ball to properly align with the backboard and net. The player can rotate the hands to the left by pressing the left arrow button 52*b* or to the right by pressing the right arrow button 52*c*. The player maintains pressure on the buttons until the hands appear to be in proper position to shoot the ball. The buttons continuously pulse digital signals to the controller, while the player maintains the button as described above. When the hands appear to be in position, the player releases the arrow button and presses the shoot button 52*d* and the ball releases from the hands and disappears though the top of the display 32*e*.

The controller 100 of gaming device 10 maintains software adapted to determine whether the player chose the correct angle from which to shoot the basketball. Said software, for example, determines if the direction selected by the player is within a predetermined tolerance from the center of the basket. Referring to FIG. 8C containing the display 32*f*, after the software of the controller determines if the player chose the right angle from which to shoot, the game shows the ball appear from the top of the screen and either miss left, miss right or go through the net. The game preferably provides appropriate sounds such as a "swish" for a make, a "bang" for the ball hitting the rim or backboard and the roar or boos of the crowd depending upon the result. The display 32*f* illustrates the ball affecting the object 66 or basket as it travels thought the net of the basket. The game takes away one ball from the successful outcome indicator 68 and updates the award meter 70 with the appropriate award from the award array 58 of the database 56.

The examples of FIGS. 7 and 8 contain an outcome determiner 60 that has an attempt-producing device 62, i.e., the gun and hands with a basketball. The present invention contemplates an example in which the outcome determiner does not contain an attempt-producing device 62, but which has an attempt or action 64 and an object 66 effected by the attempt or action. For example, the shooting gallery embodiment can provide a display, wherein no gun is provided; rather when the player selects the player interface 52, the game provides a suitable sound and the result of a breaking glass or bottle or no breaking glass or bottle. In the basketball embodiment, the game can provide a display wherein only the object 66, i.e., the backboard and basket moves until the player selects the interface 52*a*, and the display shows a basketball making or not making a basket.

Figure 9:
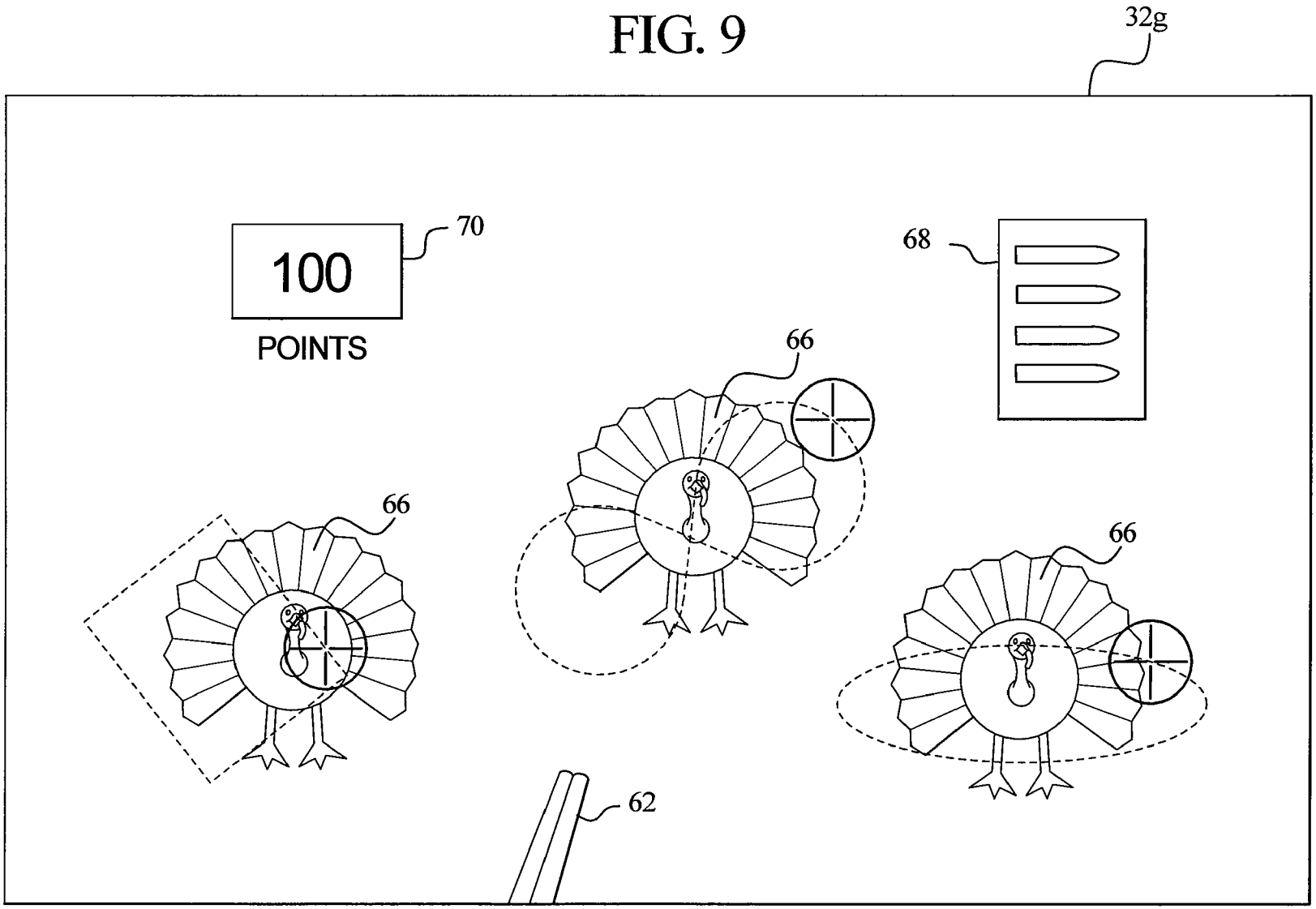
FIG. 9 is an enlarged front elevational view of the display device having a display of another embodiment of the present invention, wherein the player's skill appears to determine when the game provides an award.

Referring now to FIG. 9, an alternative embodiment is shown wherein the game randomly determines whether a player's attempt or action 64 is successful. That is, the controller 100 is not programmed to determine if the player's timing or aim is accurate; rather, the game maintains a certain probability of success; e.g., 60% and randomly determines the player's success or failure. It should be appreciated that the game can maintain any desired probability of success; however, the game preferably sets the probability to a point that enables the bonus round to proceed expeditiously. The present embodiment provides an illusion that the player's skill at an action determines whether the player wins an award.

The screen 32*g* of FIG. 9 preferably includes a touch screen 46 and a plurality of objects 66 such as turkeys effected by the action 64 which is turkey shooting in this example. The present embodiment contemplates providing one or more objects 66 or turkeys. The screen 32*g* also preferably contains a successful outcome indicator 68, wherein a number of bullets indicate the number of "hits" or successful outcomes that the controller maintains. As described above, the number of successful outcomes may be randomly determined or predetermined. The screen 32*g* preferably maintains an award meter 70 that updates the player's accumulated award for the round as the player converts successful attempts into credits or multipliers.

The present embodiment preferably does not provide an attempt-producing device, e.g. a gun, at all times; rather the game produces a gun when the player attempts to shoot one of the turkeys. When the bonus round begins, the game displays a number of turkeys or objects 66 each having crosshairs moving in circular, "figure 8" or some other desirable pattern about the body, head and area surrounding the turkey. The crosshairs (and an associated shot) are thus at times not superimposed upon (not going to hit) the turkey. The game appears to make a player judge or determine the right time to shoot a turkey. When the player judges that a crosshair is on one of the turkeys, the player touches the touch screen 46 in the area of the desired turkey.

The present embodiment preferably provides a suitable message such as, "touch a turkey and split his tail features" or "don't take that from a turkey, touch him and shoot the gun." The turkeys preferably appear and disappear in different places on the screen 32*g*. When the player touches a turkey, the game preferably displays the attempt-producing device 62, i.e. a shotgun, which aims at the turkey and fires. The player hears the sound of the gunshot and smoke or fire from the gun. The game also represents the turkey being hit (e.g. the game shows a cooked turkey or a turkey flying away to heaven) or displays a suitable message informing the player of a miss. These visual and audio productions form the attempt 64.

When the player presses a turkey, the game randomly determines whether the gunshot hits the turkey. That is, the player can press a turkey when the crosshairs of the gun are clearly not superimposed upon the turkey and still hit the turkey. The skill at aiming or timing has no effect, which is different than the previous embodiment. The game randomly selects whether the player hit the turkey based upon a predetermined percentage. If the game randomly selects that the player hit the turkey, the game randomly determines and awards an award from the award array 58 of the database 56 and displays and adds the award to the award meter 70. The game also removes one of the bullets or successful outcomes from the indicator 68. If the game randomly determines that the player does not hit the turkey, the game enables the player to make another attempt until the player exhausts all successful outcomes.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming system comprising:

a display device;

an input device;

a processor; and a memory device which stores a plurality of instructions, which, when executed by the processor, cause the processor to operate with the display device and the input device to:

(a) receive a wager by a player for a play of a game; and (b) after receiving the wager, display a bonus round, and in said bonus round:

(i) determine a number of successful outcomes from a plurality of different possible numbers of successful outcomes, said number being at least two, each of said successful outcomes associated with one of a plurality of different award groups, each of said award groups including a plurality of different awards, (ii) display a number of attempts at producing the successful outcomes, said number of attempts determined based on how many attempts are needed to produce said determined number of successful outcomes in the bonus round, each attempt including the player activating the input device, wherein, for each attempt, the determination of whether said attempt results in one of the successful outcomes is without regard to correct timing or correct aiming by the player using the input device, and wherein the number of attempts displayed in the bonus round can be greater than the determined number of successful outcomes, and (iii) for each successful outcome, randomly select one of the plurality of different awards from the award group associated with said successful outcome and provide the selected award to the player.

2. The gaming system of claim 1, wherein for each attempt, the plurality of instructions, when executed by the processor, cause the processor to randomly determine whether said attempt results in one of the successful outcomes.

3. The gaming system of claim 2, wherein for each attempt, the plurality of instructions, when executed by the processor, cause the processor to employ a probability of determining whether said attempt results in one of said successful outcomes.

4. The gaming system of claim 1, which includes an attempt producing device displayed by the display device which initiates the attempt on the display device after the player activates the input device.

5. The gaming system of claim 1, which includes an object displayed by the display device which is effected by one of the attempts which results in one of the successful outcomes.

6. The gaming system of claim 1, wherein at least one of the plurality of awards is a wild symbol.

7. The gaming system of claim 6, wherein the wild symbol increases an average value of subsequently obtained awards.

8. The gaming system of claim 1, wherein the number of successful outcomes is determined based on at least one designated symbol appearing on at least one reel in the game.

9. The gaming system of claim 1, wherein the number of successful outcomes is determined based on at least one designated card appearing in the game.

10. The gaming system of claim 1, wherein the plurality of instructions, when executed by the processor, cause the processor to randomly determine the number of successful outcomes from the plurality of different possible numbers of successful outcomes.

11. The gaming system of claim 1, wherein the plurality of instructions, when executed by the processor, cause the processor to randomly determine the number of successful outcomes from the plurality of different possible numbers of successful outcomes and, for each successful outcome, randomly select one of the plurality of awards from the award group associated with said successful outcome to provide to the player.

12. A method of operating a gaming system, said method comprising:

(a) receiving a wager by a player for a play of a game;

(b) after receiving the wager, causing a processor to operate with a display device and an input device to display a bonus round upon a triggering event, and (c) in said bonus round:

(i) causing the processor to determine a number of successful outcomes from a plurality of different possible numbers of successful outcomes, said number being at least two, each of said successful outcomes associated with one of a plurality of different award groups, each of said award groups including a plurality of different awards;

(ii) causing the display device to display a number of attempts at producing the successful outcomes, said number of attempts determined based on how many attempts are needed to produce said determined number of successful outcomes in the bonus round, each attempt including the player activating the input device, wherein, for each attempt, the determination of whether said attempt results in one of the successful outcomes is made without regard to correct timing or correct aiming by the player using the input device, and wherein the number of attempts displayed in the bonus round can be greater than the determined number of successful outcomes; and (iii) for each successful outcome, causing the processor to randomly select one of the plurality of different awards from the award group associated with said successful outcome and provide the selected award to the player.

13. The method of claim 12, which includes, for each attempt, causing the processor to randomly determine whether said attempt results in one of the successful outcomes.

14. The method of claim 13, which includes, for each attempt, said determination of whether said attempt results in one of said successful outcomes is based on a probability of generating one of the successful outcomes.

15. The method of claim 12, which includes causing the display device to display an attempt-producing device which initiates the attempt after the player activates the input device.

16. The method of claim 12, which includes causing the display device to display an object which is effected by one of the attempts which results in one of the successful outcomes.

17. The method of claim 12, wherein at least one of the plurality of awards is a wild symbol.

18. The method of claim 17, wherein the wild symbol increases an average value of subsequently obtained awards.

19. The method of claim 12, wherein the number of successful outcomes is determined based on at least one designated symbol appearing on at least one reel in the game.

20. The method of claim 12, wherein the number of successful outcomes is determined based on at least one designated card appearing in the game.

21. The method of claim 12, wherein (a) to (c) are executed over a data network.

22. The method of claim 21, wherein the data network is an internet.

23. The method of claim 12, which includes causing the processor to, for each successful outcome, randomly select one of the plurality of awards to provide to the player.

24. The method of claim 12, causing the processor to randomly determine the number of successful outcomes from the plurality of different possible numbers of successful outcomes and, for each successful outcome, randomly select one of the plurality of awards from the award group associated with said successful outcome to provide to the player.

* * * * *